US005409317A

United States Patent [19]

Ueno et al.

[11] Patent Number: 5,409,317

[45] Date of Patent: Apr. 25, 1995

[54] TAPE PRINTING DEVICE CAPABLE OF SETTING APPROPRIATE MARGIN

[75] Inventors: Hideo Ueno; Akihiko Niwa, both of Nagoya; Chitoshi Ito, Kasugai, all of Japan

[73] Assignee: Brother Kogyo Kabushiki Kaisha, Nagoya, Japan

[21] Appl. No.: 93,587

[22] Filed: Jul. 19, 1993

[30] Foreign Application Priority Data

Jul. 22, 1992 [JP] Japan ..... 4-217121

[51] Int. Cl.[6] ..... B41J 5/30

[52] U.S. Cl. ..... 400/61; 400/64; 400/279; 400/615.2; 400/586

[58] Field of Search ..... 400/1, 9, 17, 64, 342, 400/593, 621, 621.1, 586, 61, 279, 615.2

[56] References Cited

U.S. PATENT DOCUMENTS

| | | | |
|---|---|---|---|
| 3,429,761 | 2/1969 | Blefier . | |
| 3,530,028 | 9/1970 | Messmer . | |
| 3,985,603 | 10/1976 | Berner . | |
| 4,173,507 | 11/1979 | Tobey . | |
| 4,173,510 | 11/1979 | Tobey . | |
| 4,177,104 | 12/1979 | Parker . | |
| 4,311,399 | 1/1982 | Wegryn et al. | 400/342 |
| 4,312,597 | 1/1982 | Shimizu et al. . | |
| 4,395,144 | 7/1983 | Adams et al. | 400/30 |
| 4,685,991 | 8/1987 | Herrmann et al. . | |
| 4,877,345 | 10/1989 | Hori | 400/342 |
| 4,921,363 | 5/1990 | Nishihara et al. | 400/120 |
| 4,927,278 | 5/1990 | Kuzuya et al. . | |
| 4,973,509 | 11/1990 | Yamane . | |
| 4,976,558 | 12/1990 | Kuzuya et al. . | |
| 5,019,839 | 5/1991 | Watanabe et al. | 400/126 |
| 5,066,152 | 11/1991 | Kuzuya et al. . | |
| 5,069,557 | 12/1991 | Kuzuya et al. . | |
| 5,131,772 | 7/1992 | Yamaguchi | 400/621 |
| 5,168,814 | 12/1992 | Kuzuya et al. . | |
| 5,222,818 | 6/1993 | Akiyama et al. | 400/76 |
| 5,232,297 | 8/1993 | Kitazawa | 400/621 |
| 5,253,334 | 10/1993 | Kimura et al. | 400/586 |

FOREIGN PATENT DOCUMENTS

| | | |
|---|---|---|
| 0214461 | 3/1987 | European Pat. Off. . |
| 0215397 | 3/1987 | European Pat. Off. . |
| 0364305 | 4/1990 | European Pat. Off. . |
| 0506257 | 9/1992 | European Pat. Off. . |
| 3-68443 | 7/1991 | Japan . |
| 3-292187 | 12/1991 | Japan . |
| 5-39165 | 2/1993 | Japan . |
| 2008028 | 5/1979 | United Kingdom . |

*Primary Examiner*—Edgar S. Burr
*Assistant Examiner*—John S. Hilten
*Attorney, Agent, or Firm*—Oliff & Berridge

[57] ABSTRACT

When a tape cassette having a special tape, such as a lettering tape, is mounted into a tape printing device, which normally permits user set margins, for printing image data on a tape by driving a thermal head and a tape feed motor until all image data is printed out, the user set margin is disregarded and the tape is automatically fed for predetermined amount for setting a predetermined rear margin behind the print end portion. The tape is then automatically fed further for the same amount prior cutting the tape, at the rear end of the margin by driving a tape cutter mechanism. Thus, a rear margin is provided for the cut tape and a front margin established before the next print start portion. The amount the tape is fed is an amount that is long enough to hold the lettering tape when an image printed on the tape is transferred onto the image receiving medium.

23 Claims, 8 Drawing Sheets

| ITEM | INSTRUCTIONS |
|---|---|
| S11 | IS TEXT DATA IN TEXT MEMORY ? |
| S12 | DETECT TAPE DETECTION SENSOR |
| S13 | IS TAPE CASSETTE INSTALLED ? |
| S14 | MAKE PRINT IMAGE DATA |
| S15 | IS TOTAL PRINT LENGTH MORE THAN 25mm ? |
| S16 | PRINT ONE DOT COLUMN OF IMAGE DATA |
| S17 | IS ALL IMAGE DATA PRINTED ? |
| S18 | LETTERING TAPE ? |
| S19 | LETTERING TAPE ? |
| S20 | FEED TAPE 25mm |
| S21 | FEED TAPE 25mm |
| S22 | CUT TAPE AT REAR EDGE |
| S23 | WIDE MARGIN ? |
| S24 | IS A LENGTH OF PRINTING EQUAL TO A CALCULATED LENGTH ? |
| S25 | CUT TAPE AT FRONT EDGE |
| S26 | FEED AMOUNT OF SET MARGIN |
| S27 | ACTUATE BUZZER |

Fig.7B

| ITEM | INSTRUCTIONS |
|---|---|
| S11 | IS TEXT DATA IN TEXT MEMORY ? |
| S12 | DETECT TAPE DETECTION SENSOR |
| S13 | IS TAPE CASSETTE INSTALLED ? |
| S14 | MAKE PRINT IMAGE DATA |
| S15 | IS TOTAL PRINT LENGTH MORE THAN 25mm ? |
| S16 | PRINT ONE DOT COLUMN OF IMAGE DATA |
| S17 | IS ALL IMAGE DATA PRINTED ? |
| S18 | LETTERING TAPE ? |
| S19 | LETTERING TAPE ? |
| S20 | FEED TAPE 25mm |
| S21 | FEED TAPE 25mm |
| S22 | CUT TAPE AT REAR EDGE |
| S23 | WIDE MARGIN ? |
| S24 | IS A LENGTH OF PRINTING EQUAL TO A CALCULATED LENGTH ? |
| S25 | CUT TAPE AT FRONT EDGE |
| S26 | FEED AMOUNT OF SET MARGIN |
| S27 | ACTUATE BUZZER |

TAPE PRINTING DEVICE CAPABLE OF SETTING APPROPRIATE MARGIN

BACKGROUND OF THE INVENTION

1. Field of the Invention

The invention relates to a tape printing device for printing an image such as characters on a tape-like member, and more particularly to a tape printing device capable of setting an appropriate margin between one edge of a tape-like member and a print start position and between the other edge of the tape-like member and a print end position.

2. Description of Related Art

Conventionally, tape printing devices for making a lettering tape for transferring an image, such as characters and symbols, printed on the tape to an image transferred material, such as paper and cloth, used by causing the printed side of the lettering tape and the image transferred material to confront and rubbing the non-printed side of the lettering tape have been proposed. Generally, in the conventional tape printing devices, the lettering tape is made by printing characters on a base tape for lettering having a special adhesive layer on the surface where the characters are printed through an ink ribbon. The surface of the base tape for lettering is processed such that the printed characters are easily attached thereon when they are printed and the characters are easily transferred to the image transferred material by rubbing the non-printed side of the lettering tape.

A base tape for lettering which is printed in the above tape printing device, especially a tape printing device having a thermal printing mechanism, is disclosed in U.S. Pat. No. 4,973,509.

Moreover, another type of lettering tape printed by the tape printing device is an iron-on print tape. The characters printed on the iron print tape are transferred to the image transferred material, such as cloth, by confronting the printed side of the iron print tape with the image transferred material and heating the non-printed side of the iron print tape by the iron or other heat source. Such an iron print tape is disclosed in Japanese Patent Laid-Open No. 3-292187 which was published on Dec. 24, 1991.

Further, as the base tapes for the pressure lettering tape and for the iron-on print have special surfaces, they must be handled with care. A tape feeding mechanism for the handling of these types of tapes is disclosed in U.S. Pat. Nos. 4,976,558, 5,069,557 and 5,168,814. The lettering tape can be made with the tape printing device having a thermal printing mechanism by the above identified tape feeding mechanism.

The object of such lettering tapes is to transfer character images printed on the lettering tape to an image transferred material, such as paper and cloth. Therefore, it is necessary to set a large margin at one end, or both ends, of the tape in order for the user to hold the tape on the image transferred material during the transferring operation.

However, the conventional tape printing device does not consider setting the special margin for these specialized tapes, such as the lettering tape, even if it has a margin setting function. Therefore, it is necessary to set the margin for the specialized tapes when the image is printed thereon after an image has been printed on a tape other than the specialized tape, the other tape having a narrow or no margin. Further, when an image is printed again on a tape other than the special tape, the necessary margin must be set again. Thus, it is necessary to set the margin each time the tape cassette is changed which is very troublesome.

SUMMARY OF THE INVENTION

An object of the invention is to provide a tape printing device capable of printing images, such as characters, figures and symbols, on tape-like members with a margin appropriate to the tape used.

The object of the invention is achieved by providing a tape printing device comprising a housing having a tape cassette holder for holding a removable and replaceable cassette, a detector provided in the housing for detecting the mounting of one of a first tape cassette and a second tape cassette into the housing, a tape feeder provided in the housing for feeding a tape-like member for printing an input image thereon and for setting a predetermined margin, a margin determiner coupled to the tape feeder for setting the predetermined margin at least at one of front and rear portions of the image to be printed on the tape-like member when the first tape cassette is detected by the detector, a margin setter coupled to the tape feeder for setting margins arbitrarily selected by an operator at at least one of the front and rear portions of the image to be printed on the tape-like member when the second tape cassette is detected by the detector, and a tape cutter provided in the housing for cutting the tape-like member fed for printing.

In the tape printing device of the invention thus structured, the detector detects the type of the tape installed in the device when the print key is pressed. When the detected tape is a special kind of tape, the tape feeder feeds the tape for the distance equivalent to the predetermined margin set by the margin determiner, and the input image is printed. After printing of all of the character images is completed, the tape feeder feeds the tape again for the distance equivalent to the predetermined margin, and the fed tape is then cut by the tape cutter.

When the detected tape is not a special kind of tape, the tape feeder feeds the tape for a distance equal to the margin set by the margin setter and the input image is printed. After printing of all of the character images is completed, the tape feeder feeds the tape again for the distance equivalent to the margin set by the margin setter and the fed tape is then cut by the tape cutter.

Thus, according to the invention, it is possible to produce a printed length of the special kind of tape that always has a predetermined margin between one edge of the special kind of tape and the print start position and between the other edge of the special kind of tape and the print end position.

BRIEF DESCRIPTION OF THE DRAWINGS

A preferred embodiment of the invention will be described in detail with reference to the following figures, wherein:

FIG. 7B is a table listing the steps of the flowchart of FIG. 7A;

DETAILED DESCRIPTION OF THE PREFERRED EMBODIMENT

A tape printing device according to the invention is described with reference to FIGS. 1 through 8.

Figure 1:
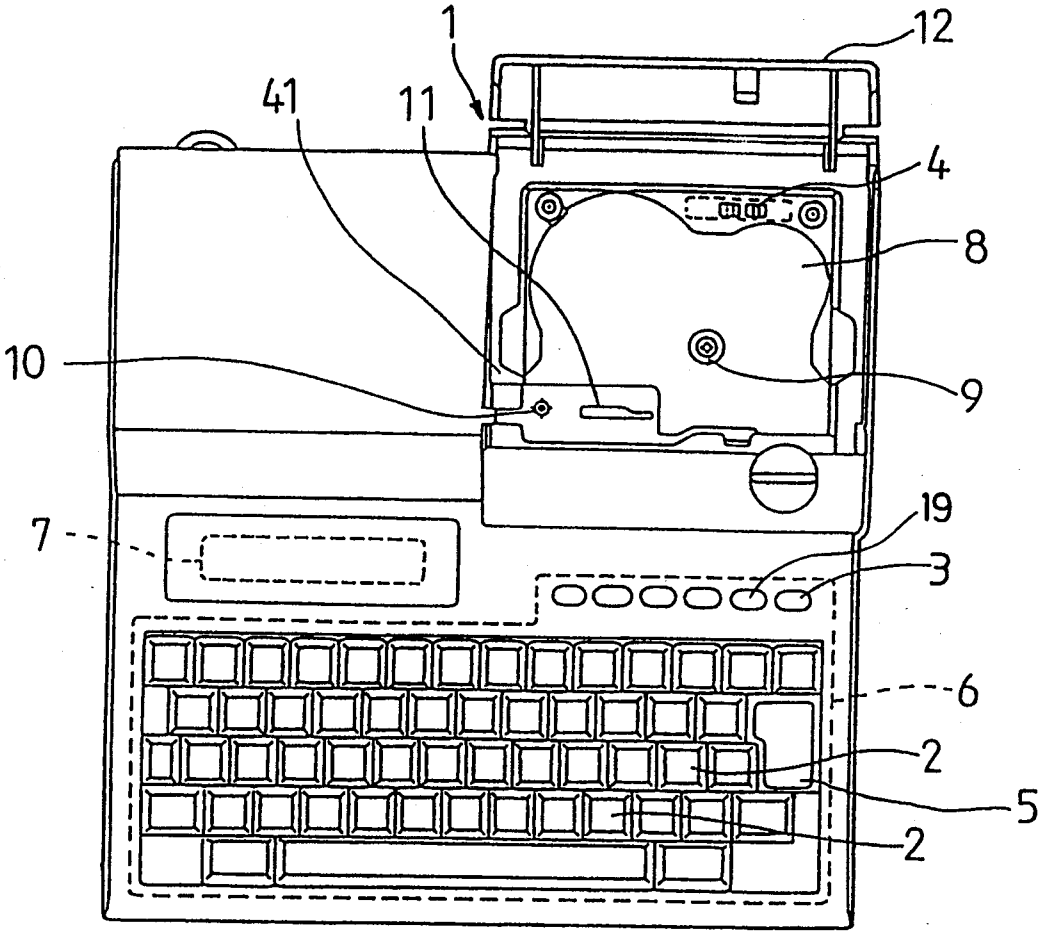
FIG. 1 is a plan view showing a tape printing device with the cover of a tape cassette holding portion open.

FIG. 1 is a plan view of a tape printing device 1. A keyboard 6 includes a plurality of keys for performing various controls of the tape printing device, such as a character input keys 2 for inputting characters, figures or symbols, a print key 3, a return key 5 for instructing the start of a new line or to execute various processing, and a special margin setting key 19 for setting a special margin when a special tape is provided to the tape printing device 1. Provided in the vicinity of the keyboard 6 is a liquid crystal display 7 for displaying characters input from the keyboard 6. A tape cassette holding portion 8 for holding a tape cassette 13, to be described below, is also provided as a part of the tape printing device 1.

Moreover, the tape cassette holding portion 8 has a ribbon take-up cam 9, which is driven to rotate by a pulse motor (not shown), for taking up a thermal ink ribbon 17 by rotating a ribbon take-up spool 21 of the tape cassette 13. Diagonally to the front of the ribbon take-up cam 9 (at the side of the keyboard 6 in FIG. 1) is a tape feed roller cam 10 for rotating a tape feed roller 27, described below, which is driven to rotate by a tape feed motor 40, described below, through an appropriate transmission mechanism.

In the lower side of the tape cassette holding portion 8 (at the side of the keyboard 6 in FIG. 1) is a thermal head 11 for printing images on a film tape 15, as described below, using the thermal ink ribbon 17. Moreover, the tape cassette holding portion 8 is opened and shut by a tape cassette holding cover 12 that is pivotally supported on the tape printing device 1. The tape cassette 13 can be replaced when the holding cover 12 is open.

In the upper side of the tape cassette holding portion 8 (away from the keyboard in FIG. 1) is a tape detection actuator 4. The tape detection actuator 4 detects the presence of the tape cassette 13 when the tape cassette 13 is installed in the tape cassette holding portion 8. The tape detection actuator 4 also detects the type of tape cassette 13 installed, such as a cassette containing laminating tape or one containing lettering tape. The tape cassette detection actuator 4 is actuated, based upon the type of tape cassette 13 installed, by the shape of a tape cassette identification part 29 provided on a lower casing 14 of the tape cassette 13. The actuation of the tape cassette detection actuator 4 is detected by a detector 54, which sends a signal to a control device 30, provided in the tape printing device 1. The tape cassette detection actuator 4 and the tape cassette identification part 29 have a known structure so that their detailed explanation will be omitted. For example, they are disclosed in Japanese Utility Model Laid-Open No. 3-68443.

Figure 2:
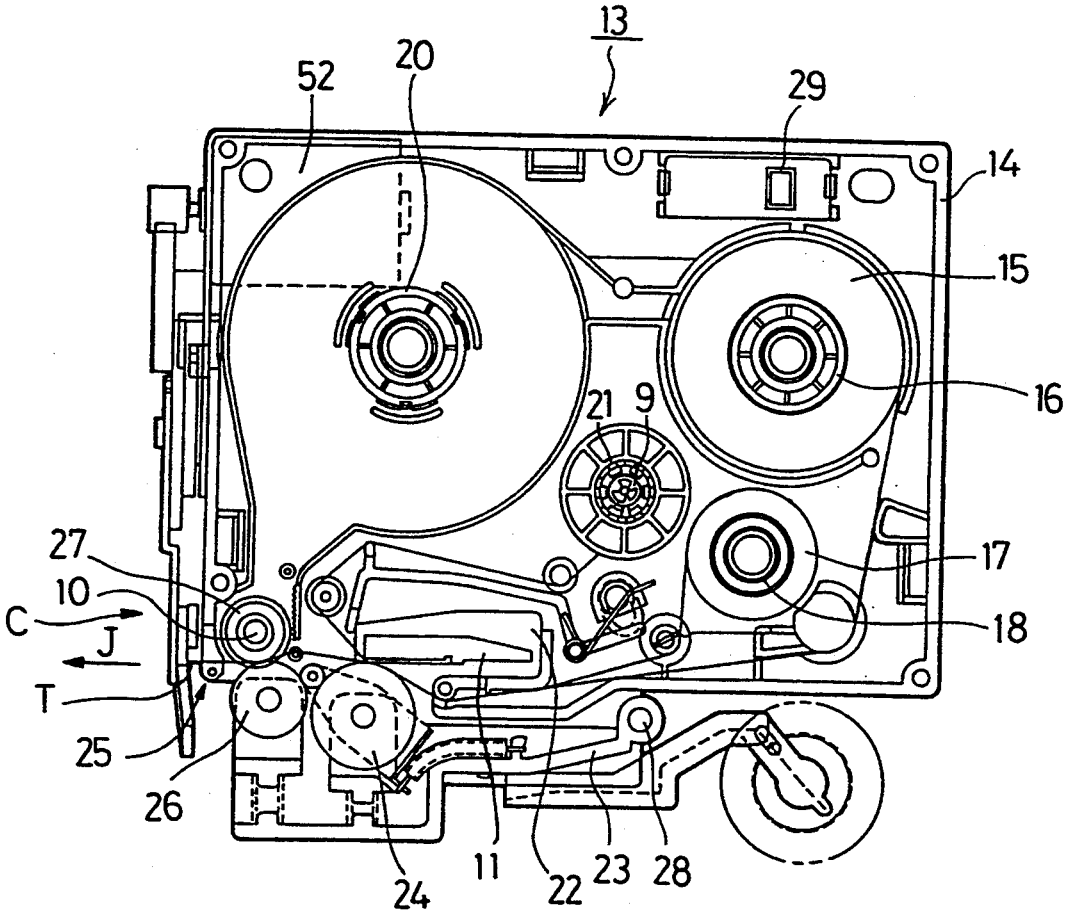
FIG. 2 is a plan view showing the internal arrangement of the tape cassette that is installed in the tape cassette holding portion.

Next, the structure of the tape cassette 13 will be described with reference to FIG. 2. FIG. 2 is a plan view showing an internal arrangement of a tape cassette which is installed in the tape cassette holding portion. The tape cassette 13 is shown with its upper casing removed.

Provided in the lower casing 14 of the tape cassette 13 are a tape spool 16, around which a lettering tape 15 is wound, and a ribbon spool 18, around which a thermal ink ribbon 17 is wound. Both spools 16,18 are rotatably supported by a supporting unit (not shown) arranged on a lower surface of the upper casing. The lettering tape 15 which is disclosed in U.S. Pat. No. 4,973,509 can be used in the tape cassette 13.

Between spools 16,18, as shown in FIG. 2, is a ribbon take-up spool 21 that is rotatably supported in the lower casing 14. The ribbon take-up spool 21 engages the ribbon take-up cam 9 and the used thermal ink ribbon 17 is wound around the ribbon take-up spool 21 by the rotation of the ribbon take-up cam 9.

At the front side of the tape cassette 13 (at the lower side in FIG. 2), a roller holder 23 is pivotally supported by a support shaft 28. The roller holder 23 can be moved between a printing position and a release position by a manual change mechanism. FIG. 2 shows the state where the roller holder 23 is switched to the printing position.

The roller holder 23 rotatably supports the platen roller 24 and the tape support roller 26. The platen roller 24 presses against a thermal head 11 and the tape support roller 26 contacts the tape feed roller 27 when the roller holder 23 is switched to the printing position. The platen roller 24 and the support roller 26 are separated from the thermal head 11 and the tape feed roller 27 respectively when the roller holder 23 is in the release position.

The thermal head 11 is received in a hollow 22 provided in the lower casing 14 of the tape cassette 13 when the tape cassette 13 is inserted into the tape holding portion 8. The platen roller 24, is mounted to confront the thermal head 11 and presses the lettering tape 15 and the thermal ink ribbon 17 against the thermal head 11. The thermal head 11 has a large number of heat-generating elements. For example, 128 heat-generating elements are installed in the thermal head 11 of the tape printing device 1 of this embodiment. This structure permits printing an image on the lettering tape 15 using the thermal ink ribbon 17.

Moreover, a tape discharging portion 25 is provided in the lower casing 14 (at the left lower side in FIG. 2). Mounted in the vicinity of the tape discharging portion 25 is a tape feed roller 27. A tape support roller 26 is arranged to confront with the tape feed roller 27 and to press the lettering tape 15 against the tape feed roller 27.

The tape feed roller 27 is driven to rotate by the tape feed roller cam 10 and the tape support roller 26 is rotated in synchronization with the rotation of the tape feeding roller 27 by a gear mechanism (not shown). Moreover, the tape support roller 26 and the tape feed roller 27 feed the lettering tape 15, on which images have been printed by the thermal head 11 using the thermal ink ribbon 17, in the direction indicated by an arrow J as a printed tape T. A tape cutter mechanism C is provided in a side frame 41 of the tape cassette holding portion 8 at the left side of the tape cassette 13 as shown in FIG. 2. The tape cutter mechanism C is driven by a cutter motor 52 to cut the tape T when the tape printing process is completed. The construction and operation of the tape cutter mechanism C is disclosed in detail in Japanese Patent Laid Open No. 5-39165.

A tape cassette having other than the lettering tape, for example, a tape cassette having a laminating tape, can also be installed in the tape cassette holding portion 8. In the tape cassette having the laminating tape, the film tape is wound around the tape spool 16. A dual sided adhesive tape having both front and rear surfaces formed with an adhesive agent, with a releasable paper adhered to one adhesive surface thereof, is wound around a spool 20 with a releasable paper facing outwardly. The adhesive surface of the dual sided adhesive tape is superposed with the film tape prior to being subjected to pressure while passing between the tape support roller 26 and the tape feed roller 27 and being fed in the direction indicated by an arrow J as printed tape T.

Figure 3:
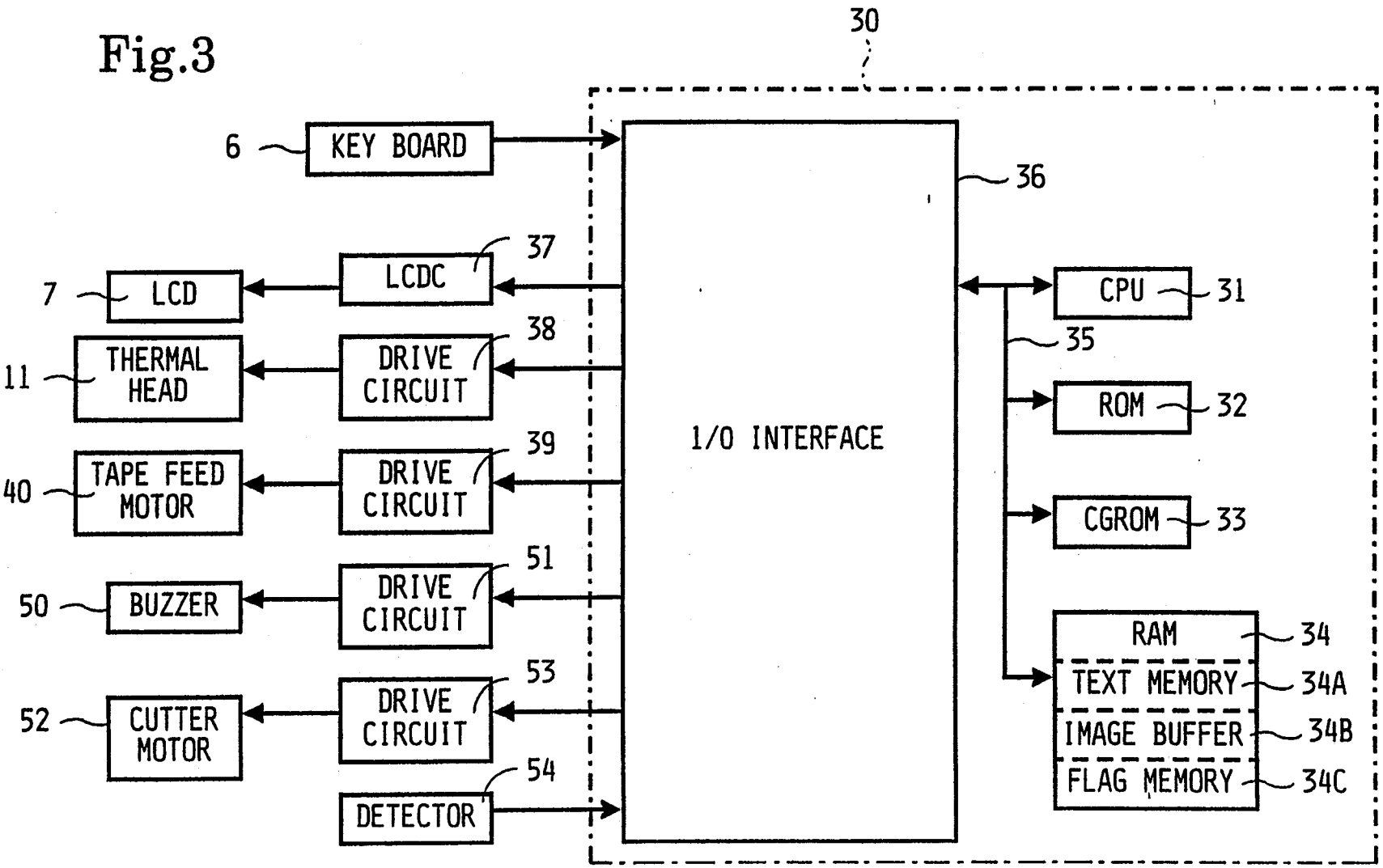
FIG. 3 is a block diagram showing a control circuit for the tape printing device.

The control arrangement of the tape printing device 1 will be described with reference to the block diagram shown in FIG. 3.

The control device 30 has a CPU 31 to provide for overall processing. The CPU 31 is connected to a ROM 32, a CGROM 33 and a RAM 34, through an I/O interface 36 and a bus 35, such as a data bus.

The ROM 32 stores various programs, such as a tape print control program, a margin setting program and various other programs necessary for controlling the tape printing device 1. The CPU 31 executes operations based on the programs stored in the ROM 32.

The CGROM 33 stores dot pattern data which corresponds to each character input from the keyboard 6.

Further, the RAM 34 temporarily stores various operation results controlled by the CPU 31. The RAM 34 includes a text memory 34A, an image buffer 34B, and a flag memory 34C which stores flag data showing the amount of set margin.

The keyboard 6 and a liquid crystal display controller (LCDC) 37 for outputting display data to a liquid crystal display (LCD) 7 are connected to the control device 30 through the I/O interface 36. When the character is input from the keyboard 6, the input character data is stored in the text memory 34A of the RAM 34 as entered and the character input by the keyboard 6 is displayed on the liquid crystal display 7, based on a dot pattern generation control program and a display control program which are stored in the ROM 32. Further, a drive circuit 38 for driving the thermal head 11, a drive circuit 39 for driving the tape feed motor 40, a drive circuit 51 for a warning buzzer 50, a drive circuit 53 for driving the tape cutter motor 52 and the detector 54 are connected to the control device 30 through the I/O interface 36.

The thermal head 11 is driven through the drive circuit 38 and prints dot data developed by the image buffer 34B. The tape feed motor 40 feeds the tape T through the drive circuit 39 in synchronization with the printing operation by the thermal head 11.

The margin setting and printing operations, of the tape printing device 1 thus structured, are explained with reference to FIGS. 4 through 8. In the flowcharts, Si (i=1,2,3, . . . ) identifies the steps.

Figure 4:
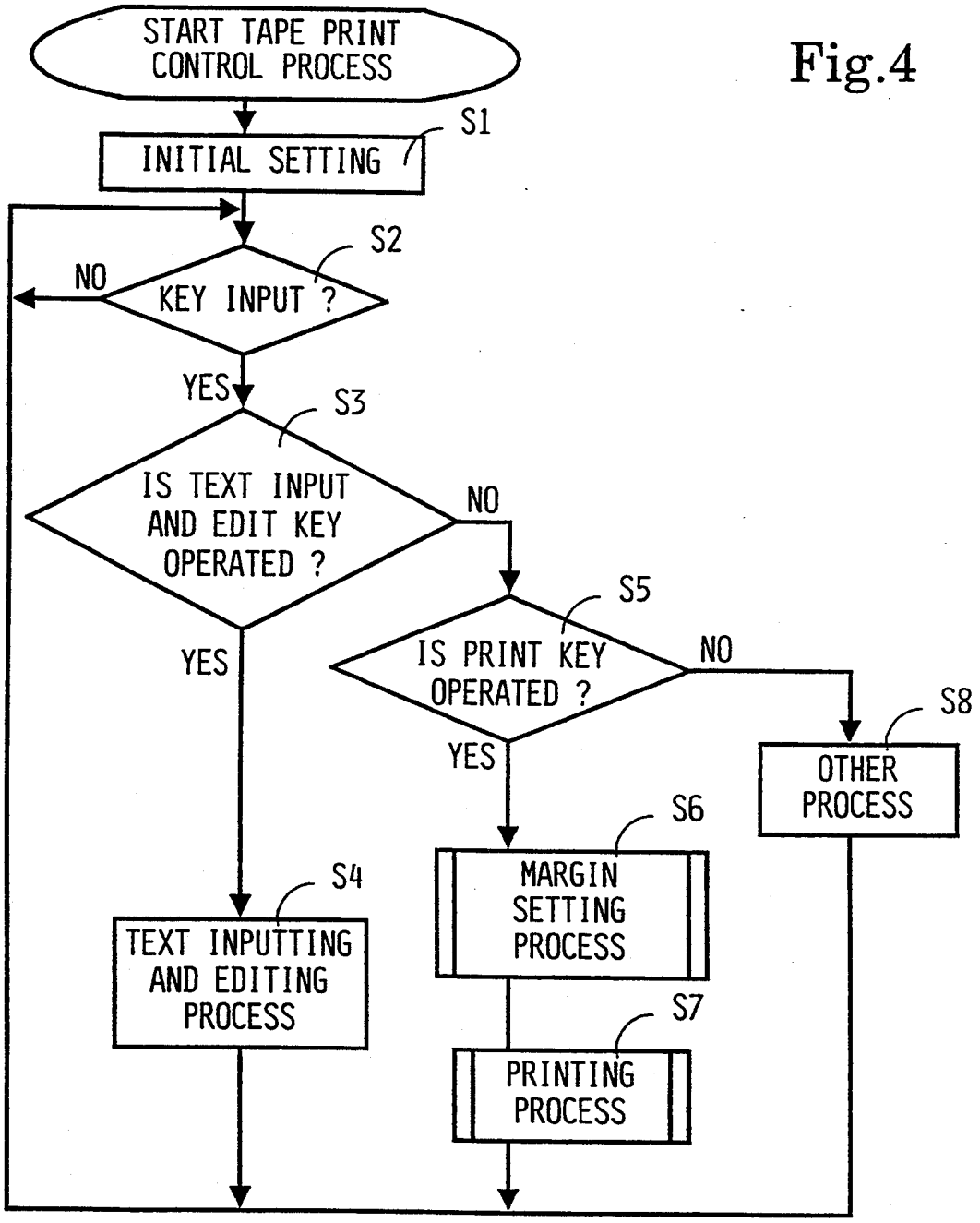
FIG. 4 is a flowchart of a tape print control program.

FIG. 4 is a flowchart of the tape print control process. At the beginning of the tape print control process, an initial setting routine is executed. The data stored in the text memory 34A and image buffer 34B, provided in the RAM 34, is cleared (S1). At step S2, it is determined whether a key is input from the keyboard 6. When a key is input (S2:YES), the flow goes to step S3. When no key is input (S2:NO), the process returns to step S2 until a key is input. At step S3, it is determined whether the input key is a text input and edit key, such as a character input key 2 or the return key 5. When a text input and edit key is input (S3:YES), a text inputting and editing process, which corresponds to the input key, is executed in step S4. The flow then returns to step S2.

When a text input and edit key is not input (S3:NO), it is determined whether the input key is a print key at step S5. When the print key is input (S5:YES), a margin setting process is executed at step S6 followed by the printing process being executed at step S7. The flow then returns to step S2. The margin setting and print processes are described below.

When the print key is not input (S5:NO), a process corresponding to the input key is executed in step S8 and, then, the flow returns to step S2.

Figure 5:
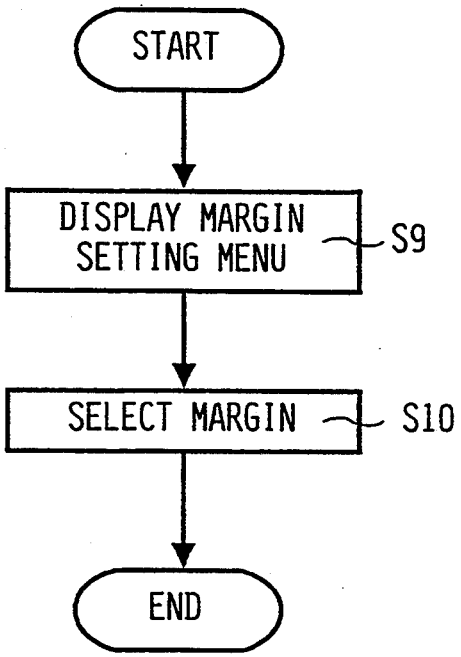
FIG. 5 is a flowchart of a margin setting process.
Figure 6:
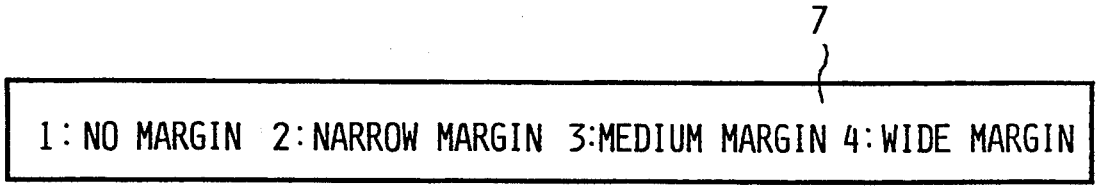
FIG. 6 is a display of a margin setting menu.

The margin setting process, which is executed in step S6, is explained with reference to FIGS. 5 and 6. FIG. 5 shows the flowchart of the margin setting process. FIG. 6 is a display showing a margin setting menu used by the margin setting process.

First, at step S9, the margin setting menu, as shown in FIG. 6, is displayed on the liquid crystal display 7. In this embodiment, four margins are displayed on the display 7. At step S10, the desired margin is selected by pressing figure keys "1", "2", "3" and "4" of the character input keys 2. That is, when the figure key of "1" is pressed, the flag data in the flag memory 34C in the RAM 34 becomes "1"; when the figure key of "2" is pressed, the flag data becomes "2"; when the figure key of "3" is pressed, the flag data becomes "3"; and when the figure key of "4" is pressed, the flag data becomes "4". "NO MARGIN" of "1" means a margin of 4 millimeters, "NARROW MARGIN" of "2" means a margin of 8 millimeters, "MEDIUM MARGIN" of "3" means a margin of 12 millimeters, and "WIDE MARGIN" of "4" means a margin of 25 millimeters. When the margin setting process is completed, the flow goes to the printing process of step S7 as shown in FIG. 4.

Figure 7A:
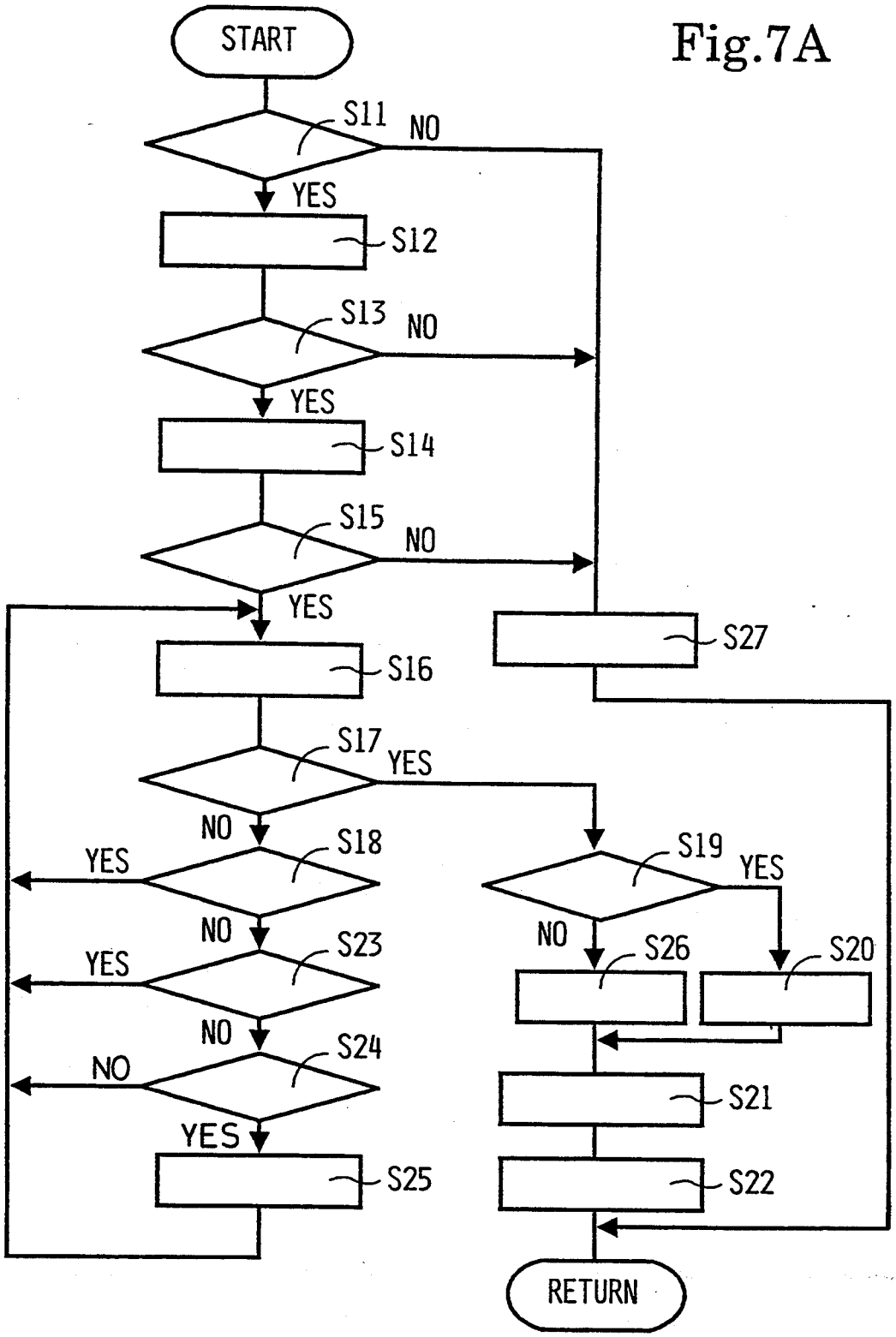
FIG. 7A is a flowchart of the print process.

The printing process, executed in step S7, is explained with reference to the flowchart of FIGS. 7A and 7B.

At step S11, it is determined whether or not there is text data to be printed in the text memory 34A of the RAM 34. When there is no text data in the text memory 34A (S11:NO) the buzzer 50 is actuated (S27) and the routine is ended. The process then returns to the tape print control process shown in FIG. 4. When there is text data in the text memory 34A (S11:YES), the signal from the tape detection actuator 4 is detected by the detector 54 at step S12. Then, at step S13, based on the signal, it is determined whether a tape cassette 13 is installed in the tape cassette holding portion 8. When a tape cassette 13 is not installed (S13:NO), the buzzer 50 is actuated (S27) and the routine ends with the process returning to the tape print control process shown in FIG. 4.

When the tape cassette 13 is installed (S13:YES), image data for printing is created based on the text data stored in the text memory 34A of the RAM 34 and the created print image data is stored in the image buffer 34B of the RAM 34 (S14). At step S15, it is determined whether or not the total print length of the print image data is more than 25 millimeters, which is equal to the distance between the thermal head 11 and the tape cutter mechanism C provided in the side frame 41. When the total print length of the print image data is not more than 25 millimeters (S15:NO), the buzzer 50 is actuated (S27), the routine ends, and the process returns to the tape print control process shown in FIG. 4. The distance between the thermal head 11 and the cutter mechanism C is also equivalent to "WIDE MARGIN" in length.

When the total print length of the print image data is more than 25 millimeters (S15:YES), the print image data of one dot column read from the image buffer 34B is printed on the tape T by driving the thermal head 11 and the tape feed motor 40 at step S16. When printing of one dot column is completed, it is determined whether printing of all print image data stored in the image buffer 34B is completed at step S17. When printing of all print image data stored in the image buffer 34B is not complete (S17:NO), it is determined whether the tape cassette 13 installed in the tape cassette holding portion 8 is a cassette containing lettering tape based on the signal from the tape detection actuator 4 at step S18. When the lettering tape cassette is installed (S18:YES), steps S16–S18 are repeated until all print image data stored in the image buffer 34B is printed.

When printing of all print image data stored in the image buffer 34B is completed (S17:YES), it is again determined whether the tape cassette 13 installed in the tape cassette holding portion 8 is a tape cassette 13 containing lettering tape based on the signal from the tape detection actuator 4 at step S19. When the lettering tape cassette 13 is installed (S19:YES), the tape T is fed the predetermined 25 millimeters, which is equivalent to the distance between the thermal head 11 and the cutter mechanism C, for setting a rear margin behind the print end portion at step S20, i.e., the tape is fed to a position where the end of the last character image is at the cutter mechanism C. In this embodiment, the amount of the margin for the lettering tape is set equal to the distance between the printing head 11 and the cutter mechanism C. Then, at step S21, the tape T is fed an additional 25 millimeters for cutting the tape T at the end position of the rear margin set in step S20. The tape T is cut by the tape cutter mechanism C at step S22, the routine ends, and the process returns to the tape print control process shown in FIG. 4.

On the other hand, when the tape cassette containing a tape other than the lettering tape is installed (S18:NO), it is determined whether "WIDE MARGIN" is set based on the flag data memorized in the flag memory 34C of the RAM 34 at step S23. When the flag data is "4" and "WIDE MARGIN" is set (S23:YES), the process returns to step S16.

When the flag data is one of "1", "2" and "3" and one of "NO MARGIN", "NARROW MARGIN" and "MEDIUM MARGIN" is set (S23:NO), it is determined whether the amount of the tape T, fed by the tape feed motor 40 during printing is equal to a calculated length equal to 25 millimeters minus the length of the set margin at step S24. When the amount of the tape T which is fed by the tape feed motor 40 during printing is equal to the calculated length, i.e. when the lead edge of the first printed character has been fed to a position equal to the length of the set margin from the cutter mechanism C (S24:YES), the cutter mechanism C is operated and the extra tape existing at the front edge of the front margin of the tape T is cut off (S25). When the amount of the tape T which is fed by the tape feed motor 40 during printing, to that point, is not equal to the calculated length (S24:NO), the process returns to step S16.

As mentioned above, in the case where the tape cassette containing a tape other than the lettering tape is installed (S18:NO), steps S16–S18 and S23 or S16–S18 and S23–S24 are repeated until the print of all image data stored in the image buffer 34B is completed.

In the case where the tape cassette contains a tape other than the lettering tape and printing of all print image data is completed (S17:YES, S19:NO), the tape T is fed further for the amount of the margin set based on the flag data for setting a rear margin behind the print end portion at step S26. Then, at step S21 the tape T is fed further for 25 millimeters for cutting the tape T at the end position of the rear margin set in step S26. The tape T is then cut by the tape cutter mechanism C at step S22, the routine ends, and the process returns to the tape print control process shown in FIG. 4.

Figure 8A:
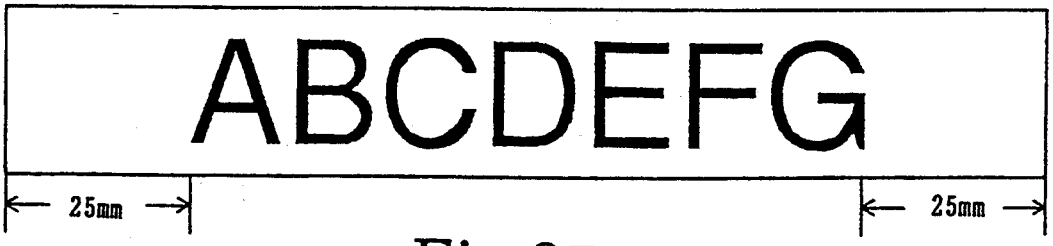
FIG. 8A is a sample of a printed tape having a wide margin.
Figure 8B:
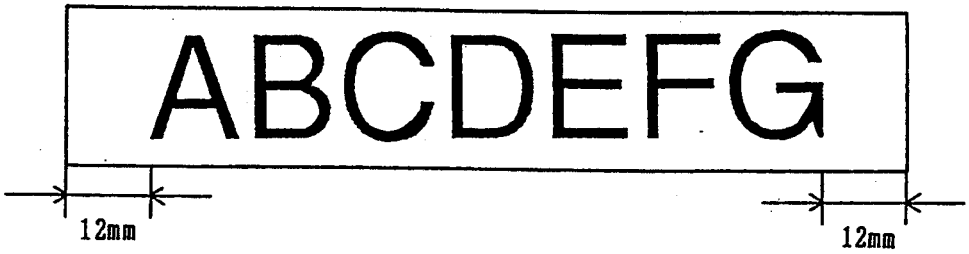
FIG. 8B is a sample of a printed tape having a medium margin.
Figure 8C:
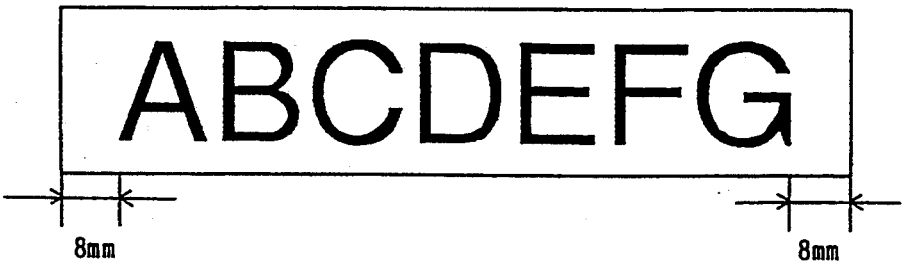
FIG. 8C is a sample of a printed tape having a narrow margin.
Figure 8D:
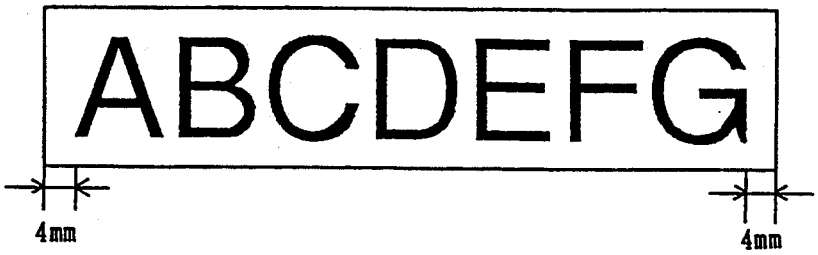
FIG. 8D is a sample of a printed tape having substantially no margin.

Samples of the printed tape T are shown in FIGS. 8A through 8D. FIG. 8A is a sample of the printed tape T with "WIDE MARGIN", that is, a margin of 25 millimeters is set between each of the front end of the tape T and the print starting position and between the trail end of the tape T and the print end position. FIG. 8B is a sample of the printed tape T using a "MEDIUM MARGIN", that is, a margin of 12 millimeters is set between each of the front end of the tape T and the print starting position and between the trail end of the tape T and the print end position. FIG. 8C shows a printed tape T with a "NARROW MARGIN", that is, a margin of 8 millimeters is set between each of the front end of the tape T and the print starting position and between the trail end of the tape T and the print end position. Lastly, FIG. 8D is a sample of a printed tape T with "NO MARGIN", that is, a margin of 4 millimeters is set between each of the front end of the tape T and the print starting position and between the trail end of the tape T and the print end position.

When an image is printed on tapes other than the lettering tape, the desired margins can be selected during the margin setting program. When an image is printed on the lettering tape, the printed result shown in FIG. 8A is obtained regardless of the setting in the margin setting program. As is clearly shown in the printed result of FIG. 8A, enough margin exists at either end for holding the tape T while the text printed on the tape T is transferred onto the image receiving medium.

As described above, according to the tape printing device, when a tape cassette containing the lettering tape therein is installed in the tape printing device, the tape T is printed with the margin equivalent to "WIDE MARGIN" regardless of setting at the margin setting program.

Therefore, when the image data is printed on the lettering tape, it is possible to obtain a printed result having enough margin at either end to hold the tape during transfer of the text printed on the tape to the image receiving medium without having to set the margin necessary for the lettering tape.

It is to be understood that the invention is not restricted to the particular forms shown in the foregoing embodiment. Various modifications and alterations can be made thereto without departing from the scope and spirit of the invention encompassed by the appended claims.

The invention can also be applied to a tape for iron print which transfers characters printed on the tape to the image receiving medium by heating the rear side of the tape with an iron.

Moreover, in the above-mentioned embodiment, the amount of the margin for the lettering tape is set at the maximum amount which can be set, i.e., 25 millimeters which is equal to the distance between the printing head 11 and the cutter mechanism C. However, the size of the margin, other than the above-mentioned 25 millimeters, could be used if the established amount is enough to easily hold the tape for the image transfer by the user. To do so, the desired amount of the margin for the lettering tape could be set by operation of the special margin set key 19 provided on the keyboard 6.

What is claimed is:

1. A printing device for printing an input image onto a tape-like member having a longitudinal axis having leading and trailing portions, comprising:

a housing having a tape cassette holder for holding a removable and replaceable cassette;

a detector in said housing for detecting mounting of one of a first tape cassette and a second tape cassette into said housing;

a tape feeder in said housing feeding the tape-like member for printing the input image and for setting a margin for at least one of leading and trailing portions of the input image;

a margin determiner coupled to said tape feeder for setting a predetermined margin which is set for at least one of leading and trailing portions of the image to be printed on the tape-like member when the first cassette is detected by said detector;

a margin setter coupled to said tape feeder for setting margins selected by an operator for at least one of the leading and trailing portions of the image to be printed on the tape-like member of the second tape cassette; and a controller coupled to said tape feeder controlling said tape feeder to feed the tape-like member of the first tape cassette according to the predetermined margin set by said margin determiner.

2. The printing device of claim 1, wherein said housing includes a tape feed roller member.

3. The printing device of claim 1, wherein said housing includes a tape cutter for cutting the tape-like member following feeding by said tape feeder.

4. The printing device of claim 1, wherein said housing includes a thermal head for printing the image and a ribbon take-up member for taking up a thermal ink ribbon used in printing.

5. The printing device of claim 4, wherein said first tape cassette has a tape for transferring the image printed thereon to an image receiving material.

6. The printing device of claim 4, wherein said second tape cassette has a tape on which the image is permanently fixed.

7. The printing device of claim 1, wherein said controller includes a margin select controller, said margin select controller overriding the margin set by said margin setter and controlling feed of the tape-like member according to the predetermined margin set by said margin determiner when the first cassette is detected by said detector, and controlling feed of the tape-like member according to the margin set by said margin setter when the second cassette is detected by said detector.

8. The printing device of claim 7, further comprising a data warning device coupled to said controller for warning when no character data is stored in said memory and for warning when the printing length of the stored character data is shorter than a predetermined length.

9. The printing device of claim 8, further comprising a cassette warning device coupled to said controller for warning when no cassette is detected in said housing.

10. The printing device of claim 1, further comprising a first memory for storing character data and the predetermined margin data set by said margin determiner.

11. The printing device of claim 10, wherein the length of the predetermined margin is equal to the distance between said thermal head and said tape cutter.

12. The printing device of claim 10, further comprising a predetermined margin setter wherein the predetermined margin can be arbitrarily set by an operator.

13. The printing device of claim 10, further comprising a second memory for storing margin data set by said margin setter.

14. A tape printing device for making a printed tape, comprising:

housing means for housing a removable and replaceable tape cassette;

input means for inputting images such as characters, figures and symbols;

printing means for printing images input by said input means on a tape-like medium stored in the tape cassette, said printing means comprising a tape feeding means for feeding the tape-like medium according to the printing;

detecting means for detecting mounting of one of a first tape cassette and a second tape cassette into said housing means;

margin setting means coupled to said printing means for setting margins arbitrarily selected by an operator for at least one of front and rear portions of the image to be printed on the tape-like medium by said printing means;

margin setting control means for controlling a margin to be set on the tape-like medium, said margin setting control means comprising a predetermined margin setting means for setting a predetermined margin independent of said margin setting means, wherein said margin setting control means overrides the margin set by said margin setting means and controls said printing means based on the predetermined margin set by said predetermined margin setting means when the first tape cassette is detected by said detecting means and controls said printing means based on a margin set by said margin setting means when the second tape cassette is detected by said detecting means; and a tape cutting means for cutting the tape-like medium after having been fed for printing and for setting the margin.

15. The printing device of claim 14, wherein said housing means includes a thermal head for printing the image and a ribbon take-up member for taking up a thermal ink ribbon used in printing.

16. The tape printing device of claim 15, wherein said first tape cassette has a tape for transferring the image printed thereon to an image receiving material.

17. The tape printing device of claim 16, wherein said second tape cassette has a tape on which the image is permanently fixed.

18. The printing device of claim 15, wherein said housing means includes a tape feed roller member.

19. The printing device of claim 14, further comprising a memory means for storing character data, margin data set by said margin setting means, and predetermined margin data set by said predetermined margin setting means.

20. The printing device of claim 19, wherein the predetermined margin setting means is operated by an operator for arbitrarily setting the predetermined margin.

21. The printing device of claim 19, wherein the length of the predetermined margin is equal to the distance between said thermal head and said tape cutter.

22. The printing device of claim 19, further comprising a data warning means for warning when no character data is stored in said memory means and for warning when the printing length of the stored character data is shorter than a predetermined length.

23. The printing device of claim 22, further comprising a cassette warning means for warning when no cassette is detected in said housing means.

* * * * *